US011497309B2

(12) United States Patent
Ruech et al.

(10) Patent No.: US 11,497,309 B2
(45) Date of Patent: Nov. 15, 2022

(54) LOADING RAIL FOR A PULL-OUT GUIDE FOR A DRAWER

(71) Applicant: Julius Blum GmbH, Hoechst (AT)

(72) Inventors: David Ruech, Sautens (AT); Lukas Kolhaupt, Lauterach (AT)

(73) Assignee: JULIUS BLUM GMBH, Hoechst (AT)

( * ) Notice: Subject to any disclaimer, the term of this patent is extended or adjusted under 35 U.S.C. 154(b) by 5 days.

(21) Appl. No.: 17/060,856

(22) Filed: Oct. 1, 2020

(65) Prior Publication Data

US 2021/0015256 A1 Jan. 21, 2021

Related U.S. Application Data

(63) Continuation of application No. PCT/AT2019/060074, filed on Mar. 7, 2019.

(30) Foreign Application Priority Data

Apr. 6, 2018 (AT) ..... A 50284/2018

(51) Int. Cl.
*A47B 88/423* (2017.01)
*A47B 88/443* (2017.01)

(52) U.S. Cl.
CPC ..... *A47B 88/423* (2017.01); *A47B 88/443* (2017.01); *A47B 2088/4235* (2017.01)

(58) Field of Classification Search
CPC ..... A47B 88/423; A47B 88/443
USPC ..... 312/334.1, 333
See application file for complete search history.

(56) References Cited

U.S. PATENT DOCUMENTS

| | | | |
|---|---|---|---|
| 5,439,284 | A | 8/1995 | Grabber |
| 5,632,541 | A | 5/1997 | Uthoff |
| 8,807,672 | B2 | 8/2014 | Gasser |
| 9,345,324 | B2 | 5/2016 | Grabherr |

(Continued)

FOREIGN PATENT DOCUMENTS

| | | |
|---|---|---|
| AT | 518232 | 8/2017 |
| CN | 103442618 | 12/2013 |

(Continued)

OTHER PUBLICATIONS

International SearchReport dated Apr. 25, 2019 in International (PCT) Application No. PCT/AT2019/060074.

(Continued)

*Primary Examiner* — James O Hansen
(74) *Attorney, Agent, or Firm* — Wenderoth, Lind & Ponack, LLP

(57) ABSTRACT

A drawer rail includes a first rail to be fixed to a drawer, and a second rail to be arranged on rail of a drawer pull-out guide. The first rail and the second rail are to be connected to one another by sliding onto each other. The first rail and the second rail are locked to one another by a locking element, with the locking element being pre-stressed by a force of a force storage member in a direction of a locking position. The locking element is arranged on the second rail and is configured to be pivoted, upon sliding the first rail onto the second rail, about a horizontally extending axis in the mounted position, starting from the locking position, against a force of the force storage member in a direction of the carcass rail or the central rail of the drawer pull-out guide into an unlocking position.

16 Claims, 11 Drawing Sheets

(56) References Cited

U.S. PATENT DOCUMENTS

| | | | | |
|---|---|---|---|---|
| 9,693,627 | B2 * | 7/2017 | Chen | A47B 88/403 |
| 10,085,558 | B2 | 10/2018 | Klaus | |
| 2011/0291539 | A1 * | 12/2011 | Leal | A47B 88/493<br>312/334.44 |
| 2014/0015390 | A1 | 1/2014 | Grabherr | |
| 2014/0055020 | A1 | 2/2014 | Gasser | |
| 2017/0105525 | A1 | 4/2017 | Klaus | |
| 2017/0135476 | A1 | 5/2017 | Chen et al. | |

FOREIGN PATENT DOCUMENTS

| | | |
|---|---|---|
| CN | 103501657 | 1/2014 |
| CN | 103584529 | 2/2014 |
| CN | 106102518 | 11/2016 |
| CN | 206852371 | 1/2018 |
| DE | 93 10 582 | 11/1993 |
| DE | 93 14 893 | 3/1994 |
| DE | 198 28 718 | 12/1999 |
| DE | 20 2013 100 013 | 3/2013 |
| EP | 2 704 605 | 9/2017 |
| JP | 2014-516648 | 7/2014 |
| JP | 2017-86865 | 5/2017 |
| WO | 2012/149586 | 11/2012 |

OTHER PUBLICATIONS

Search Report issued Sep. 3, 2021 in corresponding Chinese Patent Application No. 201980023490.8.

* cited by examiner

LOADING RAIL FOR A PULL-OUT GUIDE FOR A DRAWER

BACKGROUND OF THE INVENTION

The present invention relates to a drawer rail for a drawer pull-out guide, the drawer rail comprising a first rail configured to be fixed or fixed to a drawer, and a second rail configured to be arranged or arranged on a carcass rail or on a central rail of a drawer pull-out guide. The first rail and the second rail are configured to be connected to one another by sliding onto each other, and the first rail and the second rail, in a connected condition, are locked to one another by at least one locking element, with the locking element being pre-stressed by a force of a force storage member in a direction of a locking position.

Furthermore, the invention relates to a drawer pull-out guide comprising at least one drawer rail of the type to be described, and an item of furniture comprising a furniture carcass and a drawer displaceably supported relative to the furniture carcass. Moreover, the invention relates to a method for connecting a first rail with a second rail of a drawer rail on a drawer pull-out guide.

DE 198 28 718 A1 discloses a locking device for releasably mounting drawers to an extendable guide rail of a drawer pull-out guide. When the drawer is mounted, the drawer is placed onto the guide rail and is moved as long to the rear until a locking latch pre-stressed by a spring automatically locks into a latching opening of the drawer. In this way, it is ensured that the drawer, during normal operation, is supported so as to be non-displaceable relative to the guide rail. The locking latch, in the mounted position, is linearly displaceable in a vertical direction and includes a handle on the lower end region, and the locking between the drawer and the guide rail can be released by manually pulling the handle in a downward direction. A drawback is the fact that the installation space of the drawer pull-out guide is to be dimensioned relatively large because of the downwardly protruding locking latch.

DE 20 2013 100 013 U1 discloses a drawer pull-out guide comprising a carcass rail to be fixed to a furniture carcass, a drawer rail to be fixed to a drawer, and a central rail displaceably supported between the carcass rail and the drawer rail. On the front end region of the drawer rail, an elastic pressing element in the form of a spring tongue is arranged, the spring tongue being configured to be bendable in an upward direction when the drawer is slid onto the drawer rail, and being configured to subsequently arrest the drawer relative to the drawer rail. A drawback is the fact that the spring tongue is also visible when the drawer is in a mounted condition.

AT 518 232 A1 discloses a drawer arrangement comprising a drawer pull-out guide and a drawer sidewall, and a carrier rail is firmly connected to the drawer sidewall. On the front end of the carrier rail of the drawer sidewall, an actuating element is pivotally supported, the actuating element being configured to be releasably locked to the drawer rail of the drawer pull-out guide when the drawer sidewall is slid onto the drawer rail. A drawback is the fact that each drawer to be connected to the drawer pull-out guide must be equipped with an actuating element for locking to the drawer pull-out guide.

SUMMARY OF THE INVENTION

It is an object of the present invention to propose a drawer rail of the type mentioned in the introductory part, thereby avoiding the above-discussed drawbacks.

According to the invention, the locking element is arranged on the second rail and is configured to be pivoted, upon sliding the first rail onto the second rail, about a horizontally extending axis in the mounted position, starting from the locking position, against a force of the force storage member in a direction of the carcass rail or the central rail of the drawer pull-out guide into an unlocking position.

Accordingly, the locking element, in a mounted position of the drawer rail, is pivotally supported about a horizontally extending pivoting axis, so that the drawer, when being mounted to the drawer pull-out guide, is placed onto the first rail and is moved as long to the rear, until the locking element yields downwardly in a direction of the unlocking position, against a force of the force storage member, due to the weight of the drawer. Upon a continued insertion movement of the drawer, the drawer can be releasably locked by a force of the force storage member.

The feature of the locking element configured to be pivotable about a horizontally extending pivoting axis in the mounted position is not an obvious measure in view of the DE 198 28 718 A1 reference mentioned in the introductory part, because the handle protruding downwardly according to the DE 198 28 718 A1 reference is an essential technical feature for releasing the locking between the drawer and the guide rail.

An advantage of the invention lies in the fact that the first rail arranged on the drawer, upon sliding the first rail onto the second rail, does not require an engagement hub in a height direction. When the drawer is mounted, the drawer can thus be slid along a horizontally extending plane onto the second rail, until the locking element firstly yields downwardly, and, subsequently, snaps back again in an upward direction by a force of the force storage member so as to automatically lock the drawer relative to the second rail. Accordingly, no space in a height direction is required for locking purposes. This is a particular advantage when the drawer shall be mounted in a furniture carcass right below a worktop and, therefore, only a small distance is available between the drawer and the underside of the worktop.

The locking element is supported on the second rail. For the sake of improved accessibility, it can be advantageous if the locking element is movably supported on a front-end portion of the second rail.

In an embodiment, the locking element is passed through an opening of the second rail. In this way, a compact and aesthetically unobtrusive construction can be obtained, because the locking element is arranged, for the most part, within a cross-sectional area of a rail and merely the portion of the locking element provided for locking purposes projects from the second rail. It is preferably provided that the opening is arranged on a middle limb of the second rail, wherein it is preferably provided that the middle limb extends horizontally in the mounted position.

The at least one locking element, together with the force storage member, can have an integral one-piece construction, or, alternatively, can also be configured as components separate from one another. With the integral one-piece construction, the force storage member can be formed by a material elasticity of a plastic member. For increasing the spring force, it may, however, be beneficial when the force storage member includes a mechanical spring element (for example a leaf spring made of steel) configured to be separate from the locking element.

The drawer pull-out guide according to the invention comprises a carcass rail to be fixed to a furniture carcass and a drawer rail of the described type, and the drawer rail is displaceably supported relative to the carcass rail. In order to allow the drawer to be fully extended relative to the front face of the furniture carcass, an additional central rail may be provided, the central rail being displaceably supported between the carcass rail and the drawer rail.

The method according to the invention for connecting a first rail to a second rail of a drawer rail is characterized in that, in a first method step, the first rail configured to be fixed or fixed to the drawer is placed onto the second rail configured to be arranged or arranged on the carcass rail or on the central rail of a drawer pull-out guide. In a second method step, the first rail is slid onto the second rail; in a third method step, the locking element of the second rail is pivoted about a horizontally extending axis in the mounted position, against a force of the force storage member, in a direction of the carcass rail or the central rail of the drawer pull-out guide into an unlocking position; and in a fourth method step, the locking element is moved into a locking position by a force of the force storage member, whereby the two rails are locked to one another.

BRIEF DESCRIPTION OF THE DRAWINGS

Further details and advantages of the present invention will be described with the aid of the embodiment shown in the drawings, in which.

DETAILED DESCRIPTION OF THE INVENTION

Figure 1:
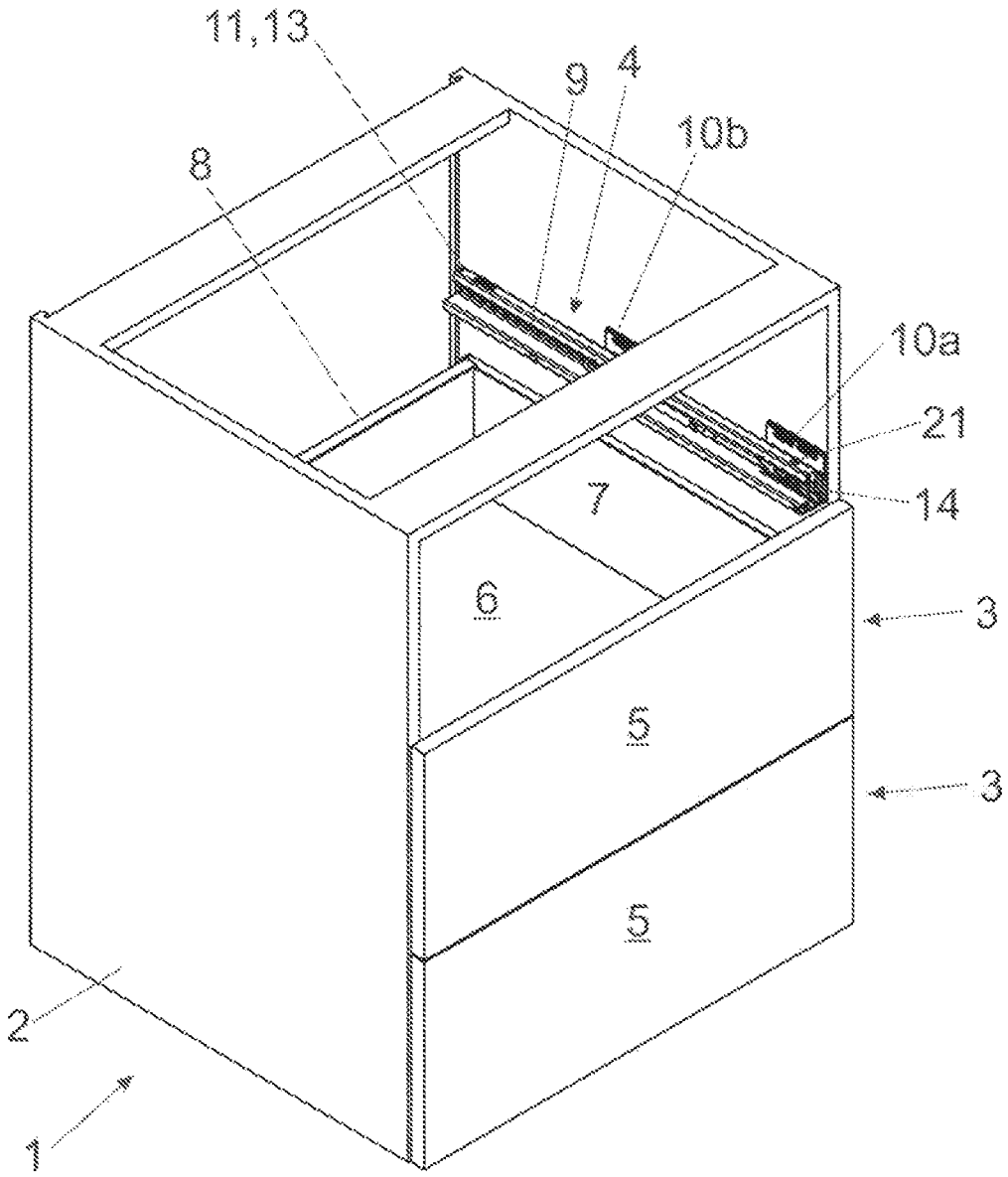
FIG. 1 shows a perspective view of an item of furniture with drawers displaceably supported relative to a furniture carcass by drawer pull-out guides.
Figure 4A:
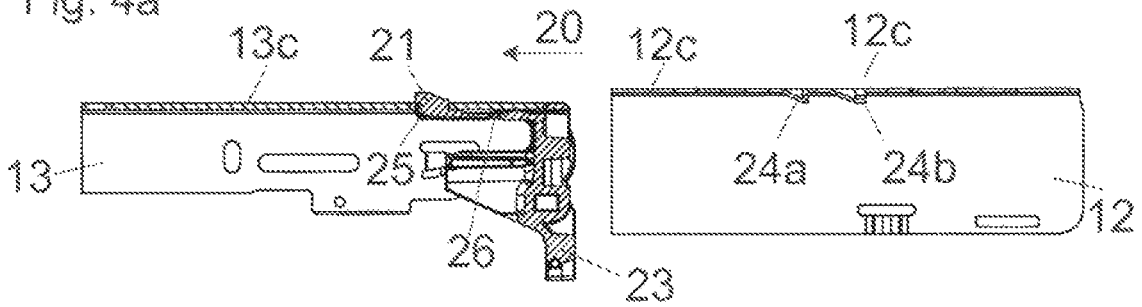
FIG. 4*a*-4*d* show the sliding operation of the first rail onto the second rail in temporally subsequent steps.

FIG. 1 shows an item of furniture 1 having a cupboard-shaped furniture carcass 2, and drawers 3 are displaceably supported relative to the furniture carcass 2 by drawer pull-out guides 4. The drawers 3 include a front panel 5, a drawer bottom 6, sidewalls 7 and a rear wall 8. The drawer pull-out guides 4 include a carcass rail 9 configured to be fixed to the furniture carcass 2 via fastening portions 10*a*, 10*b*, and at least one drawer rail 11 displaceable relative to the carcass rail 9. The drawer rail 11 has at least a two-part configuration and includes a first rail 12 (FIG. 2*a*) configured to be fixed or fixed to the drawer 3, and a second rail 13 configured to be arranged or arranged on the drawer 3. In order to enable a full-extension of the drawer 3 relative to the furniture carcass 2, an additional central rail 14 may be provided, the central rail 14 being displaceably supported between the carcass rail 9 and the drawer rail 11. The drawers 3 are to be mounted to the drawer pull-out guides 4 such that the drawer 3 is initially placed onto the second rails 13 arranged on opposing sides of the furniture carcass 2. Subsequently, the first rails 12 fixed to the drawer 3 are slid onto the second rails 13 in the longitudinal direction (L), until the first and second rails 12, 13 are automatically locked to one another by at least one locking element 21 configured to be pivotable about a horizontally extending axis 26 (FIG. 4*a*), so that the first and second rail 12, 13, in the connected condition, are arranged so as to be stationary relative to one another.

Figure 2A:
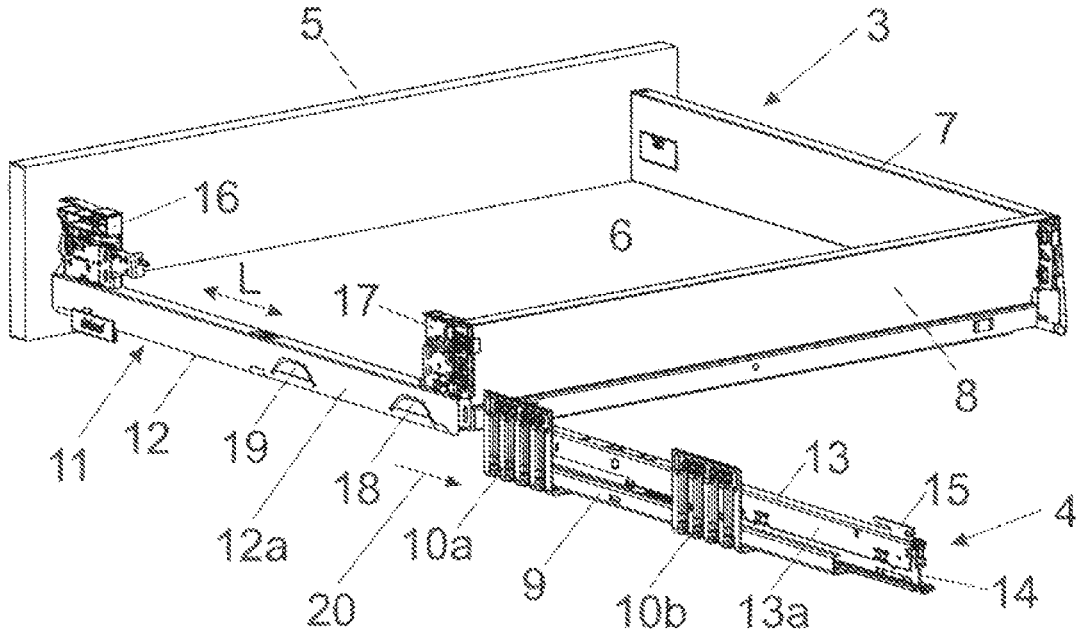
FIG. 2*a*, 2*b* show perspective views of the drawer to be fixed to the drawer pull-out guide, and the drawer mounted to the drawer pull-out guide.

FIG. 2*a* shows the drawer 3 to be fixed to the drawer pull-out guide 4 in a perspective view, in which a sidewall 7 of the drawer 3 is hidden for the sake of improved overview. Visible is the first rail 12 of the drawer rail 11, the first rail 12 being arranged on the drawer 3. In the front-end region of the first rail 12, a first fastening adaptor 16 for fixing the front panel 5 is arranged. In the rear-end region of the first rail 12, a second fastening adaptor 17 for fixing the rear wall 8 is arranged. The first rail 12 includes two side limbs 12*a*, the side limbs 12*a* extending in the longitudinal direction (L) and being spaced from each other substantially in a parallel relationship. On one of the side limbs 12*a* of the first rail 12, at least one spring member 18 in the form of an elastically bendable spring tab is arranged. The spring member 18 of the first rail 12, in the connected condition of the rails 12, 13, bears against the second rail 13, so that transverse movements of the rails 12, 13 relative to one another can be limited. In the shown embodiment, two spring members 18, 19 are provided on the first rail 12, the spring member 18, 19 being spaced from one another in the longitudinal direction (L). A hook 15 is arranged on the rear end of the second rail 13, the hook 15 being configured to limit a slid-on path of the first rail 12 relative to the second rail 13 in the sliding direction 20 and being configured to stabilize the rear end region of the drawer 3 in a direction transverse to the longitudinal direction (L) in the mounted condition. The carcass rail 9 of the drawer pull-out guide 4 is to be fixed to the furniture carcass 2 via the fastening portions 10*a*, 10*b*, and the second rail 13 of the drawer rail 11 and the central rail 14 are displaceably supported relative to the stationary carcass rail 9. The drawer 3 is to be fixed to the second rail 13 such that the first rails 12 connected to the sidewalls 7 of the drawer 3 are slid onto the second rails 13 of the drawer pull-out guides 4 in the sliding direction 20.

Figure 2B:
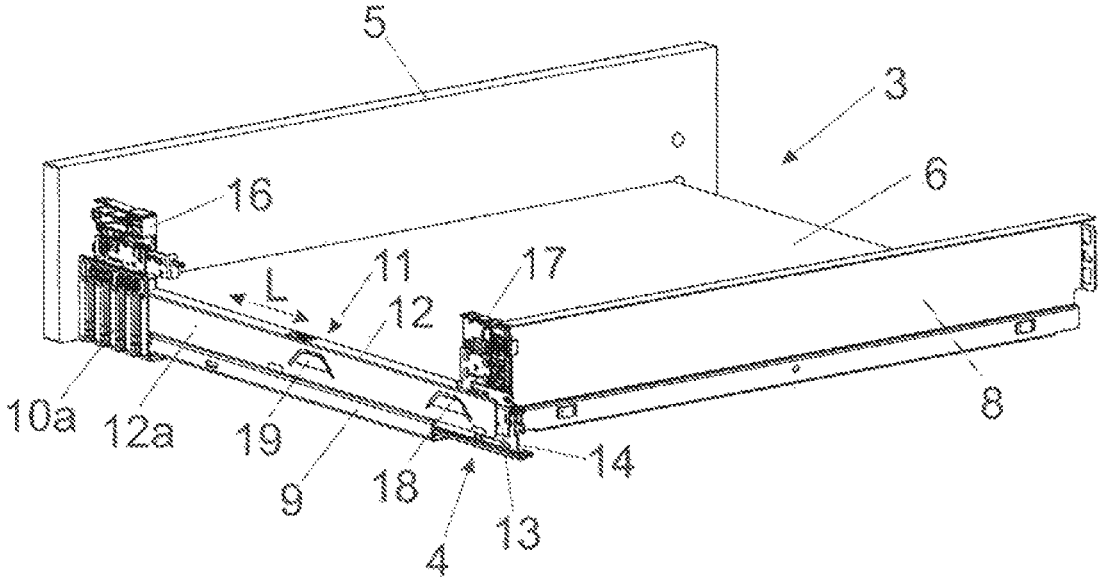

FIG. 2*b* shows the connected condition of the drawer 3 on the drawer pull-out guide 4. The second rail 13, for the most part, is received within a U-shaped profile, seen in a cross-section, of the first rail 12, and the rails 12, 13 are arranged relative to one another in a play-free manner in a direction transverse to the longitudinal direction (L), preferably laterally to the longitudinal direction (L), of the rails 12, 13 due to the arrangement of the spring member 18, 19.

Figure 3A:
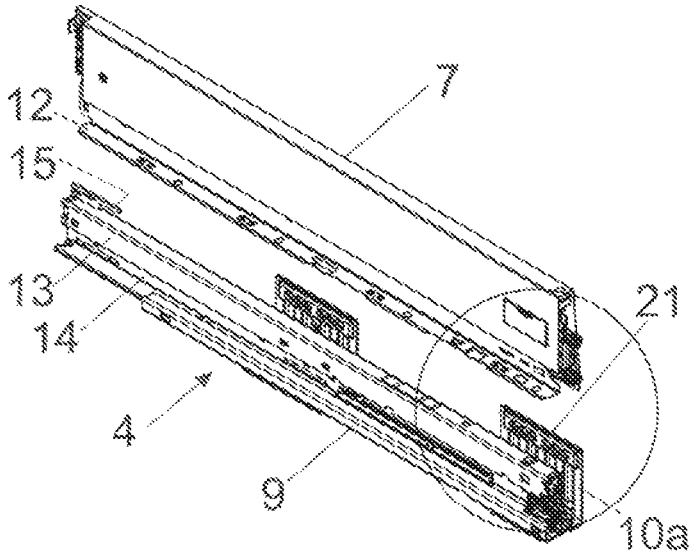
FIG. 3*a*-3*c* show the sidewall to be fixed to the drawer pull-out guide in a perspective view, in an enlarged detail view and the first and second rail in a perspective view.

FIG. 3*a* shows the drawer pull-out guide 4 with the carcass rail 9, the central rail 14 and the second rail 13, the second rail 13 is to be connected to the first rail 12 of the drawer 3.

Figure 3B:
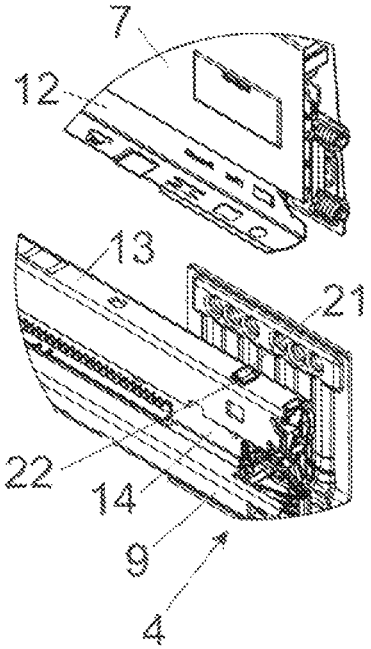

FIG. 3*b* shows the encircled region of FIG. 3*a* in an enlarged view, in which the movably-supported locking element 21 for releasably locking the rails 12, 13 is shown. The locking element 21 is arranged on the front-end region of the second rail 13 and is passed through an opening 22 of the second rail 13. When the first rail 12 is slid onto the second rail 13, the locking element 21 is configured to be pivoted, starting from the locking position, about a horizontally extending axis 26 in the mounted position, against a force of a force storage member 25, in a direction of the carcass rail 9 or the central rail 14 of the drawer pull-out guide 4 into an unlocking position.

Figure 3C:
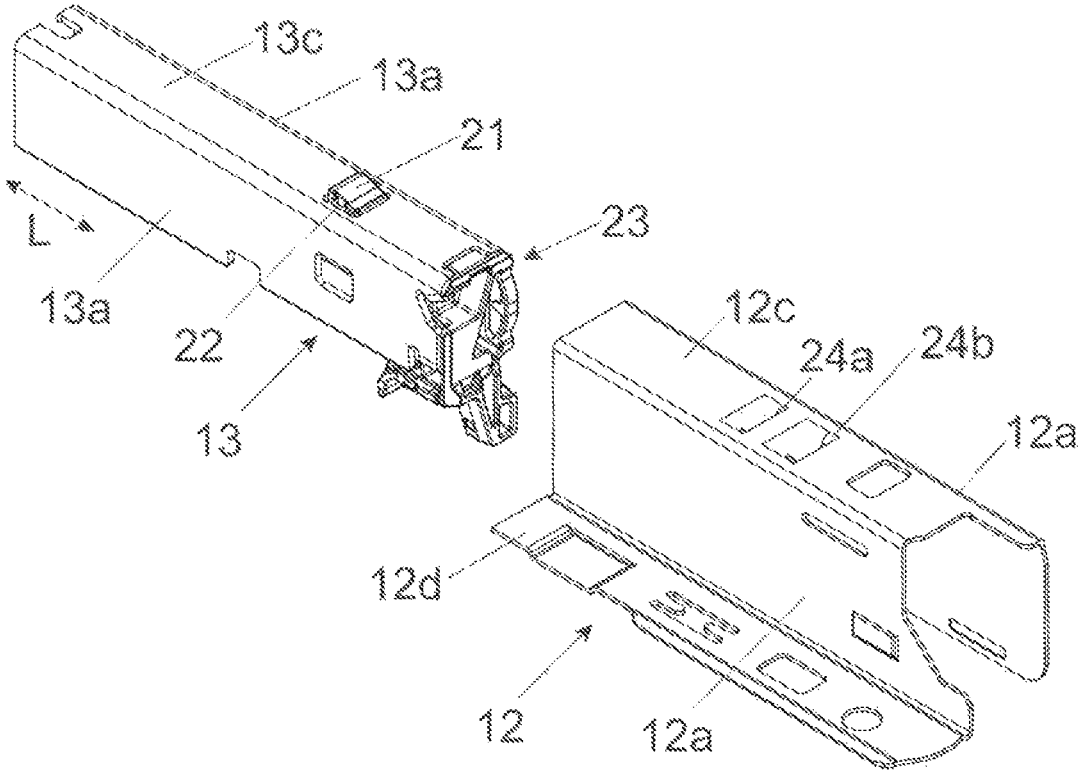

FIG. 3*c* shows a perspective view of the second rail 13 of the drawer pull-out guide 4 and the first rail 12 to be connected to the sidewall 4. The second rail 13 includes two side limbs 13*a*, preferably extending parallel to one another, and a middle limb 13*c* connecting the two side limbs 13*a*. The middle limb 13*c* of the second rail 13 includes a, for example rectangular, opening 22 for the passage of the movable locking element 21. The locking element 21 is arranged so as to be stationary in a longitudinal direction (L) and is movable in a direction approximately perpendicular to the middle limb 13*c* of the second rail 13. In the shown embodiment, the locking element 21, together with a front-sided functional head 23, has an integral one-piece construction. The functional head 23 is accommodated, for the most part, within a cross-sectional area of the second rail 13. The first rail 12 also includes two side limbs 12*a*, preferably extending parallel to one another, and a middle limb 12*c* connecting the two side limbs 12*a*. Moreover, the first rail 12 is provided with a support limb 12*d* for supporting the drawer bottom 6. The first rail 12, preferably the middle limb 12*c*, further includes at least one protrusion 24*a* projecting downwardly, the protrusion 24*a* being configured to be releasably connected to the locking element 21 of the second rail 13. In the shown embodiment, two protrusions 24*a*, 24*b* spaced from one another in the longitudinal direction (L) are provided, and the locking element 21, in a pre-locking position of the first and second rail 12, 13, can be releasably locked with the first protrusion 24*a*. In a connected condition of the first and second rail 12, 13, the locking element 21 can be releasably locked with the second protrusion 24*b*. The protrusions 24*a*, 24*b* can be configured so as to be bent out from the middle limb 12*c* of the first rail 12 in a downward direction. Alternatively, the protrusions 24*a*, 24*b* can be configured so as to be separate components from the first rail 12, the separate components being fixed to the first rail 12.

Figure 4B:
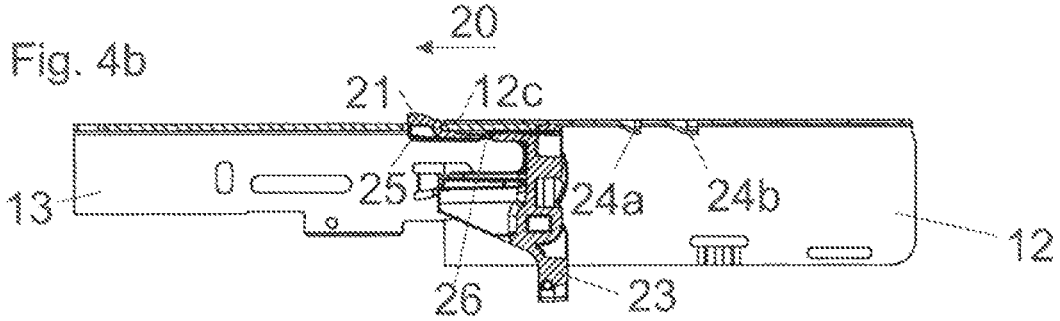
Figure 4C:
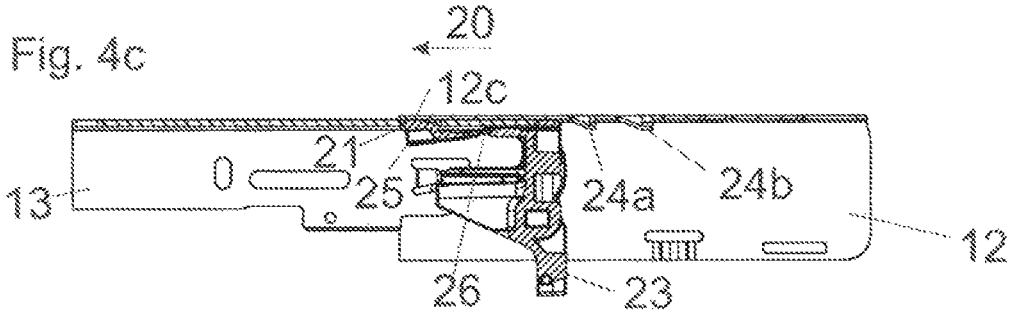
Figure 4D:
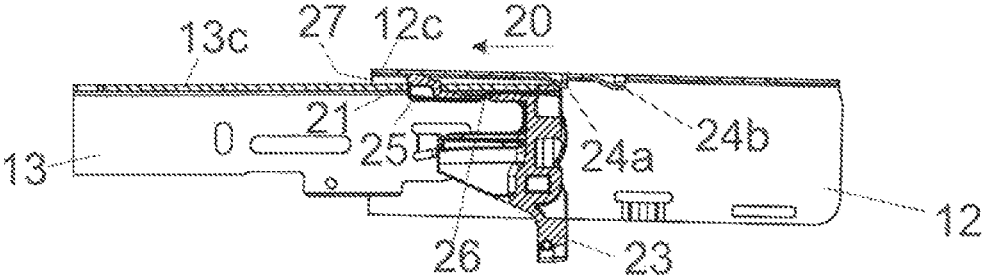

FIG. 4*a*-4*d* show the sliding operation of the first rail 12 onto the second rail 13 in longitudinal cross-sectional views. Two protrusions 24*a*, 24*b* are arranged on the first rail 12, the protrusions 24*a*, 24*b* being spaced from one another in the longitudinal direction (L) and protruding from the middle limb 12*c* of the first rail 12 in a downward direction. Arranged on the front end of the second rail 13, the functional head 23 with the locking element 21 is arranged, the locking element 21 being pivotable about a horizontally extending axis 26 in the mounted position. As shown in the cross-sectional views of FIGS. 4*a*-4*d*, the horizontal axis is perpendicular to the longitudinal axis of the first and second rails 12, 13, and extends within a plane parallel to the plane of the drawer bottom 6—i.e., into the drawing sheet. In order for the drawer 3 to be mounted on the drawer pull-out guide 4, the first rail 12 which is connected to the drawer 3 is placed onto the front end region of the second rail 13 which is pre-mounted to the furniture carcass 2, and is displaced in the sliding direction 20, the middle limb 12*c* of the first rail 12 and the middle limb 13*c* of the second limb 13 initially gliding along each other. By a continued movement of the first rail 12 in the sliding direction 20, the front edge of the first rail 12 abuts against the locking element 21 of the second rail 13 (FIG. 4*b*). By a further movement of the first rail 12 in the sliding direction 20, the locking element 21 of the second rail 13 is pivoted about the horizontally extending axis 26 against a force of the force storage member 25 (FIG. 4*c*). By sliding the first protrusion 24*a* of the first rail 12 onto the middle limb 13*c* of the second rail 13, the first rail 12 is lifted from the second rail 13 to form a gap 27, whereby the loaded force storage member 25 can relax and the locking element 21 again snaps back in an upward direction (FIG. 4*d*). This has the advantage that the two rails 12, 13, upon sliding onto one another, contact each other not via their flat middle limbs 12*c* and 13*c*, but only via the protrusions 24*a*, 24*b* In this way, the frictional resistance and possible unpleasant noise emissions can be reduced upon sliding the rails 12, 13 onto each other, so that the sliding operation of the rails 12, 13 can be effected smoothly and quietly.

Figure 5A:
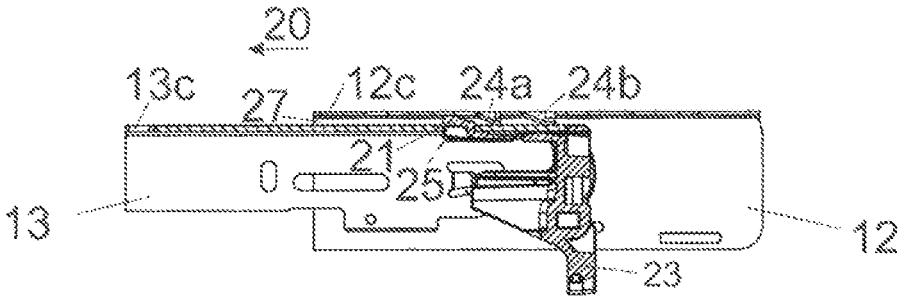
FIG. 5*a*-5*e* show a continued sliding operation of the first rail onto the second rail.
Figure 5B:
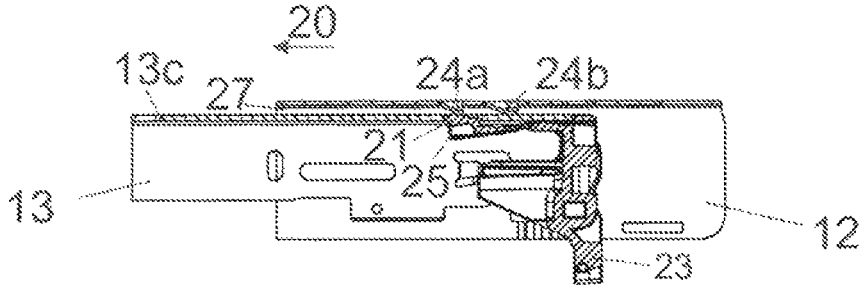
Figure 5C:
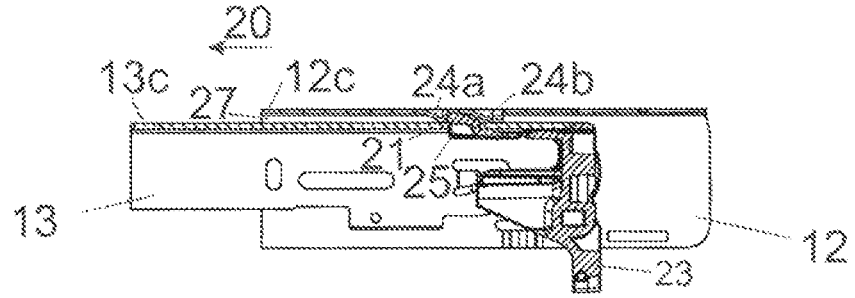
Figure 5D:
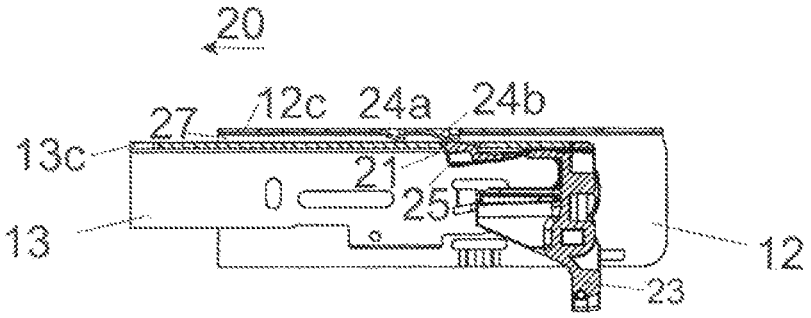
Figure 5E:
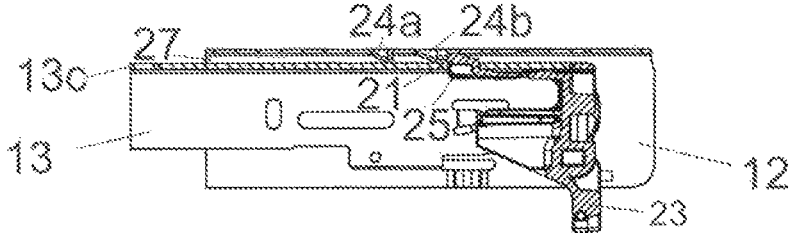

FIG. 5*a*-5*d* show a continued movement of the first rail 12 in the sliding direction 20, and both protrusions 24*a*, 24*b* now glide along the second rail 13 under the formation of the gap 27 arranged between the middle limbs 12*c*, 13*c* (FIG. 4*e*). By the first protrusion 24*a* of the first rail 12, the locking element 21 is moved about the horizontal axis 26 against a force of the force storage member 25 (FIG. 5*b*), whereupon the locking element 21 is locked with the first protrusion 24*a* in a pre-locking position (FIG. 5*c*). The pre-locking position has the advantage that the first rail 12 can be caught by the locking element 21 of the second rail 13 and provides the secure feeling for an operator that the sliding path is practically terminated, and a locking between the drawer 3 and the drawer pull-out guide 4 is established. A release of the pre-locking position, by manually applying a pulling force to the first rail 12 in a direction opposite the sliding direction 20, is no longer possible from that moment. For establishing the final connection, two different options are now available for the operator. According to a first variant, the first rail 12 can further be moved, from the pre-locking position shown in FIG. 5*c*, in the sliding direction 20 so that the locking element 21 is again pushed downwardly against a force of the force storage member 25 by the second protrusion 24*b* of the first rail 12 (FIG. 5*d*). Subsequently, the second protrusion 24*b* is automatically locked with the locking element 21 under the influence of a force of the force storage member 25, so that the rails 12, 13 are located in their connected condition and are determined relative to one another in the longitudinal direction (L) by the locking element 21 (FIG. 5*e*). According to a second variant, the first rail 12 (and therewith also the second rail 13 coupled therewith) can be moved, from the pre-locking position shown in FIG. 5*c*, by opening the drawer 3 in a direction opposite the sliding direction 20. Subsequently, the drawer 3 is again moved into the furniture carcass 2 with great momentum, and the same locking operation (see FIG. 5*d*, FIG. 5*e*), as described before, is brought about. Starting from the locked position (FIG. 5*e*), the locking of the rails 12, 13, by manually applying a force to the first rail 12 in a direction opposite the sliding direction 20, cannot be released. This constitutes a security aspect, because an inadvertent release of the rails 12, 13 from each other shall be prevented.

Figure 6A:
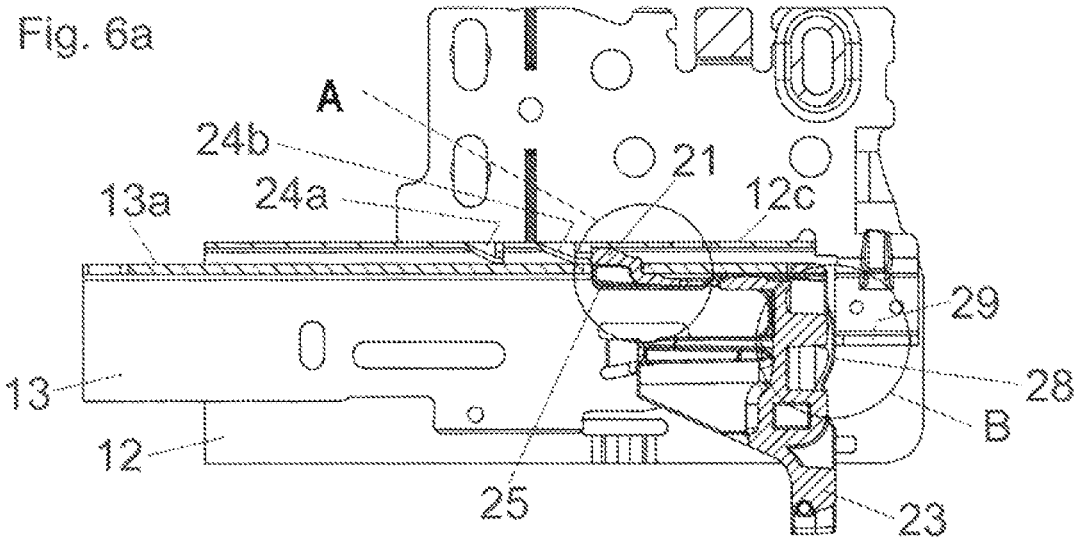
FIG. 6*a*-6*c* show the connected condition of the rails in different cross-sectional views.
Figure 6B:
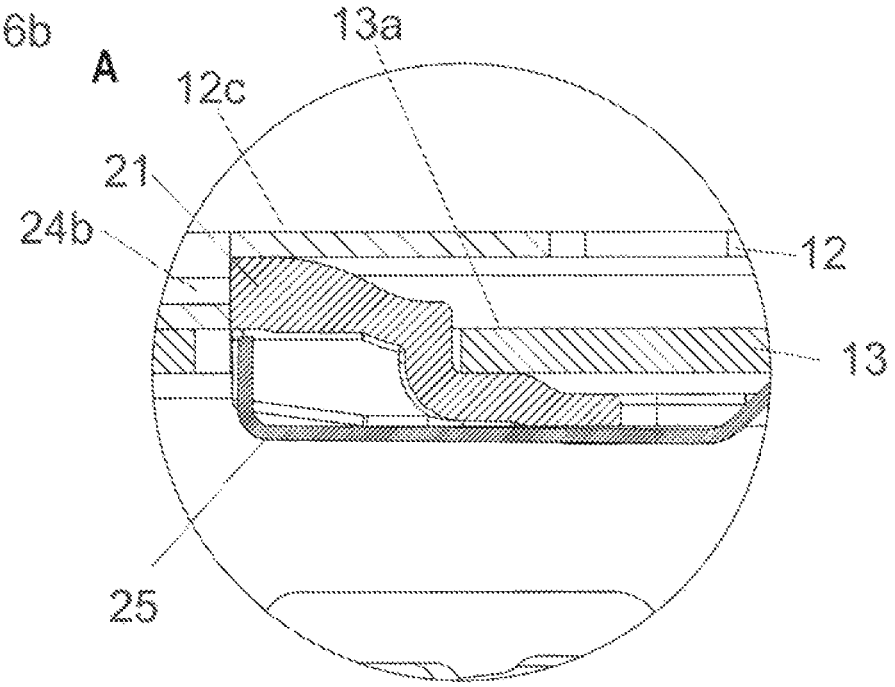
Figure 6C:
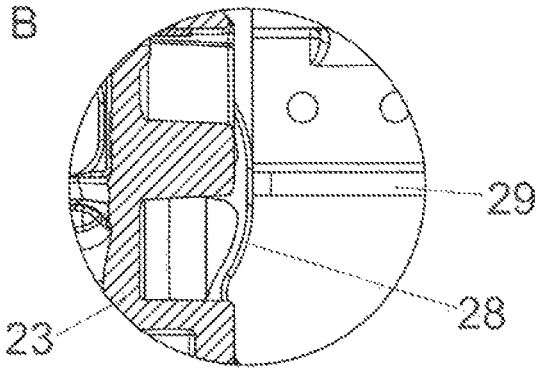

FIG. 6*a* shows the connected condition of the rails 12, 13, and the locking element 21 of the second rail 13 is locked with the second protrusion 24*b* of the first rail 12. FIG. 6*b* shows the encircled region "A" of FIG. 6*a* in an enlarged view. It is visible that the locking element 21, in the connected condition of the rails 12, 13, is covered by the middle limb 12*c* of the first rail 12. In the shown embodiment, the locking element 21, in a connected condition of the rails 12, 13, bears against an underside of the middle limb 12*c* of the first rail 12. Covering the locking element 21 has the advantage that in a connected condition of the rails 12, 13, an inadvertent actuation of the locking element 21 can be prevented. The force storage member 25 for pressurizing the locking element 21 in a direction of the locking position is formed, in the shown figure, by a leaf spring made of steel. The leaf spring is separate from the locking element 21, and an angled end region of the leaf spring presses against the locking element 21. FIG. 6*c* shows the encircled region "B" of FIG. 6*a* in an enlarged view. The functional head 23 arranged on the front-sided end of the second rail 13 includes at least one spring buffer 28 by which the rails 12, 13, in a connected condition, are arranged in a play-free manner in the longitudinal direction (L). In the connected condition, a fitting portion 29 arranged or formed on the front panel 5 of the drawer 3 namely pushes against the spring buffer 29 of the functional head 23. In this way, the remaining play between the rails 12, 13 in the longitudinal direction (L) can be compensated for.

For increasing the operating comfort, items of furniture 1 are frequently equipped with ejection devices for ejecting the drawer 3 from its closed end position in or on a furniture carcass 2 into an open position. In particular with drawers 3 without having a handle, the ejection devices are frequently configured such that the ejection devices can be triggered by moving the drawer 3 from the closed end position in a direction of the furniture carcass 2. For this purpose, a certain play of the drawer 3 in its closed end position has to be permitted. The spring buffer 28 now permits that the drawer 3, from its closed end position, can be moved in a direction of the furniture carcass 2 against a force of the spring buffer 28, whereby ejection devices with a Touch-Latch-Function can be triggered. The spring buffer 28 is, in particular, used in combination with so-called inner extension drawers, in which the front panel 5 of the drawer 3, in the closed position, does not abut against the front face of the furniture carcass 2, but is rather arranged between the sidewalls of the furniture carcass 2.

By applying a pressure to the front panel 5 of the drawer 3 configured as an inner extension drawer, the first rail 12 can be moved relative to the second rail 13 against a force of the spring buffer 28, whereby the spring buffer 28 is deformed or bent and the ejection device can be triggered. After the ejection device has been triggered, the first rail 12, possibly by a support from the ejection device, can be moved back again into the initial position. In the shown embodiment, the spring buffer 28 is formed by a compressible plastic member. Alternatively, it is possible that the spring buffer 28 includes an abutment portion for the drawer 3, the abutment portion being pressurized by a spring.

Figure 7A:
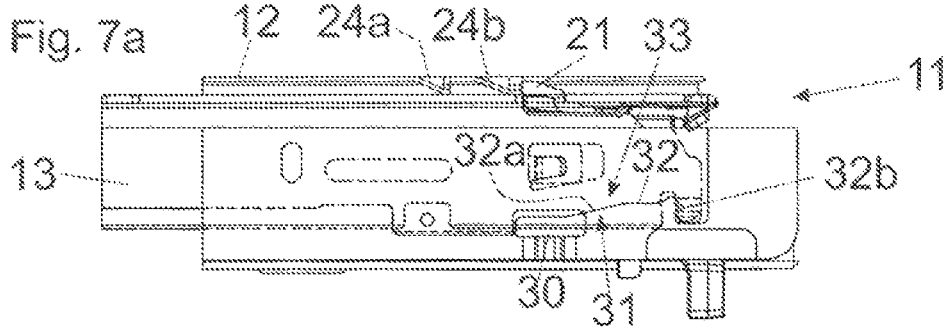
FIG. 7*a*-7*e* show the unlocking operation of the rails in temporally subsequent steps.
Figure 7B:
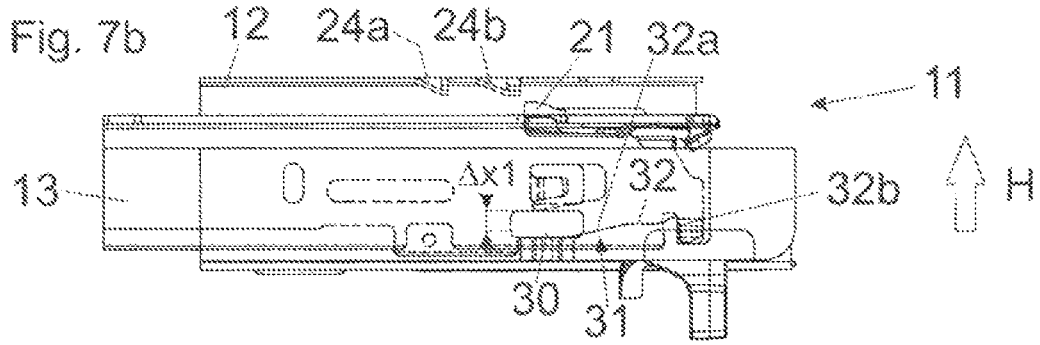
Figure 7C:
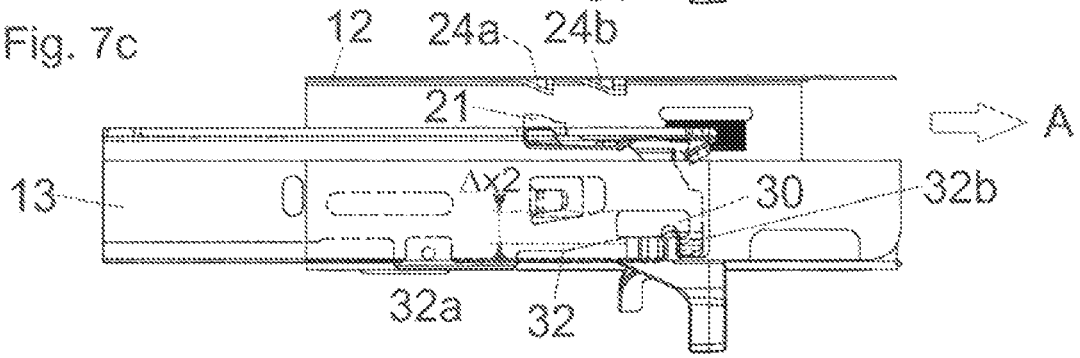
Figure 7D:
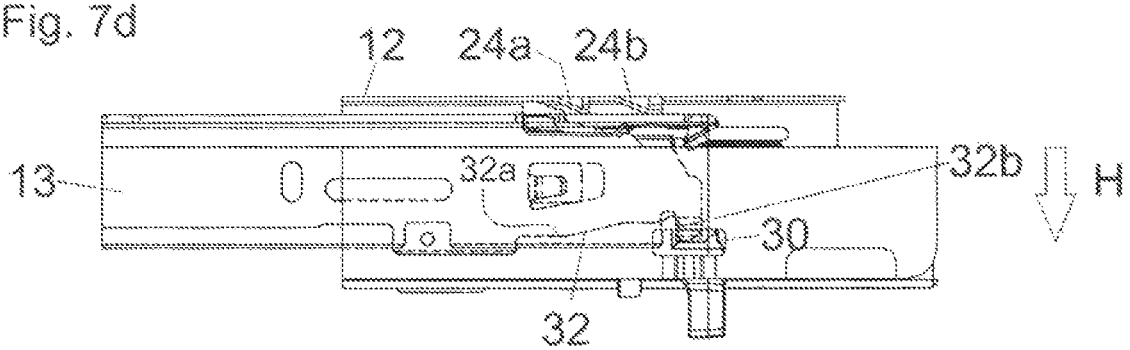
Figure 7E:
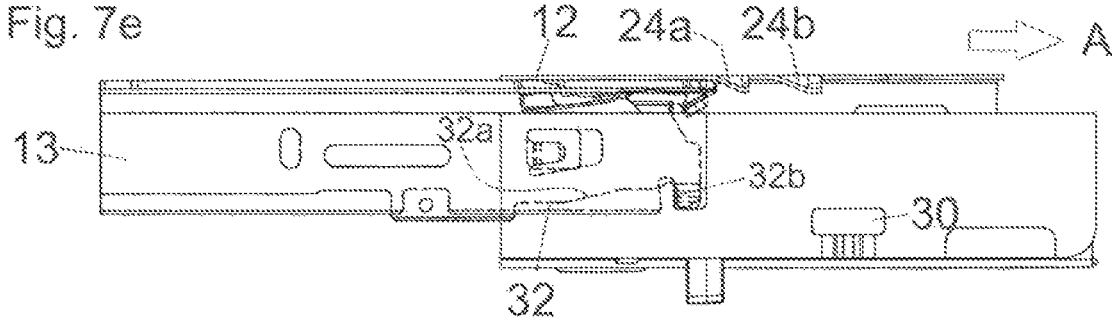

FIG. 7*a*-7*e* show the unlocking operation of the rails 12, 13 from the connected condition, in which the locking element 21 of the second rail 13 is locked with the protrusion 24*b* of the first rail 12. For unlocking the rails 12, 13, an unlocking device 33 is provided. The unlocking device 33 includes at least one engagement element 30 arranged on the first rail 12, and the engagement element 30 is received, in the connected condition of the rails 12, 13, in a recess 31 arranged on the second rail 13. The engagement element 30 is received in the recess 31 with a play in a height direction (H). The recess 31 includes a control curve 32, and the engagement element 30, starting from the connected condition of the rails 12, 13, can be guided along the control curve 32 by manually lifting the first rail 12 relative to the second rail 13. In order to unlock the locking element 21 from the protrusion 24*b*, the first rail 12 must firstly be lifted by a person by the amount Δx1 in the height direction (H) relative to the second rail 13 (FIG. 7*b*). After the first rail 12 has been lifted, the first rail 12 is moved by a person in the extension direction (A), whereby the engagement element 30 is moved with a component along a section 32*a*, extending in the extension direction (A) of the drawer 3, of the control curve 32 (FIG. 7*c*). It is preferably provided that the section 32*a* extends inclinedly relative to a horizontal line at least over a region. In this way, the engagement element 30 can be lifted by the amount Δx2 relative to the second rail 13. As shown in FIG. 7*d*, the first rail 12 is subsequently lowered by applying a force in the height direction (H), and the engagement element 30 is moved along a vertical section 32*b* of the control curve 32. Only then, the first rail 12 can be moved independently from the second rail 12 and can, as shown in FIG. 7*e*, further be moved in the extension direction (A), and, as a result, the drawer 3 can be separated from the drawer pull-out guide 4. The unlocking operation of the rails 12, 13 is thus effected by a predetermined movement pattern, namely, in the shown embodiment, by lifting the first rail 12 in the height direction H (FIG. 7*b*), by extending in the extension direction A (FIG. 7*c*), lowering in the height direction H (FIG. 7*d*) and by subsequently extending in the extension direction A (FIG. 7*e*). This movement combination constitutes a safety aspect, because an inadvertent separation of the drawer 3 from the drawer pull-out guide 4 shall be prevented in any case. In particular, it shall be ensured that the drawer 3 (in particular when the drawer 3 is the undermost drawer 3 in the furniture carcass 2) cannot be released from the drawer pull-out guide 4 by merely applying a pulling force to the drawer 3. After a pulling force has been applied, the drawer 3 must firstly be lowered (FIG. 7*d*), so that the drawer 3 can be separated from the drawer pull-out guide 4.

Figure 8A:
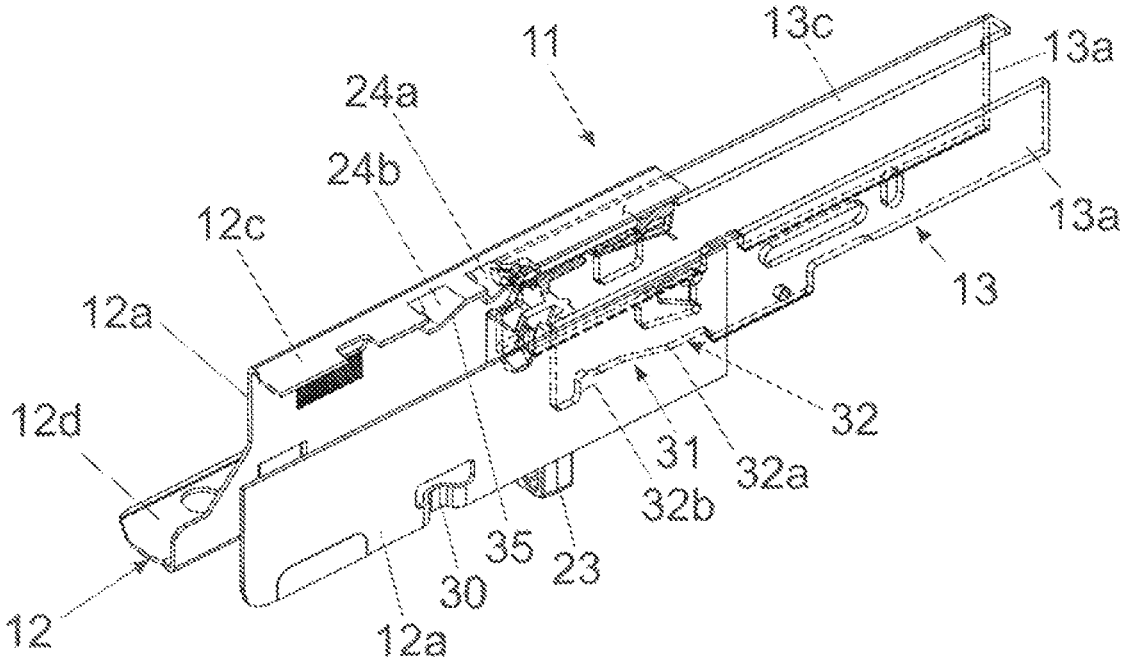
FIG. 8*a*-8*c* show the drawer rail with the first and second rail and the functional head in different perspective views.

FIG. 8*a* shows a perspective view of the drawer rail 11 with the first rail 12 to be arranged on the drawer 3, and the second rail 13 arranged on the drawer pull-out guide 4. The first rail 12 and the second rail 13 are locked to one another by the locking element 21 in the connected condition. At least one of the protrusions 24*a*, 24*b* can have an inclined surface portion 35 for moving the locking element 21, upon sliding the rails 12, 13 onto one another, in a direction of the unlocking position. Visible is the engagement element 30 arranged on the first rail 12, the engagement element 30 co-operating with the control curve 32 arranged on the second rail 12 upon unlocking the rails 12, 13, as shown and described in connection with FIGS. 7*a*-7*e*. The control curve 32, for example, can be formed by an edge of a recess 31 of the second rail 13.

Figure 8B:
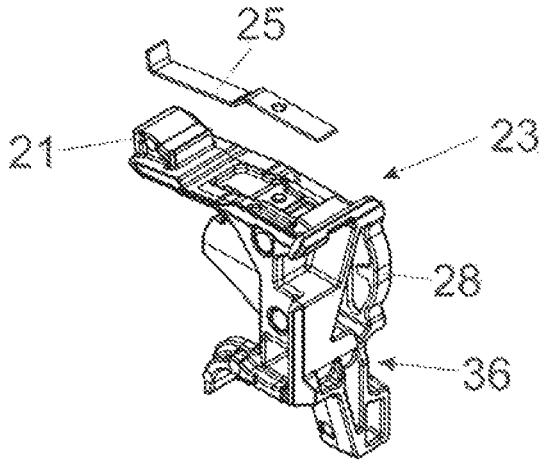
Figure 8C:
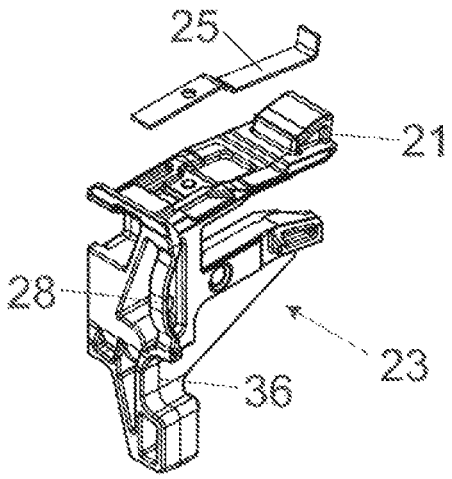

FIG. 8*a* and FIG. 8*b* show two different perspective views of the functional head 23 to be arranged on a front end of the second rail 13. For applying a force to the locking element 21, at least one force storage member 25, for example in the form of a leaf spring, is provided. Also visible is the compressible spring buffer 28 for arranging the rails 12, 13 in a play-free manner in the longitudinal direction (L) to one another. The drawer 3, starting from its closed end position, can be moved against a force of the spring buffer 28 in a direction of the furniture carcass 2, so that ejection devices having a Touch-Latch-Function can be triggered. The functional head 23 further includes a recess 36, for example in the form of a concave fillet, so that the engagement element 30, upon sliding-on and upon separating the rails 12, 13, does not collide with the functional head 23 of the second rail 13.

Figure 9A:
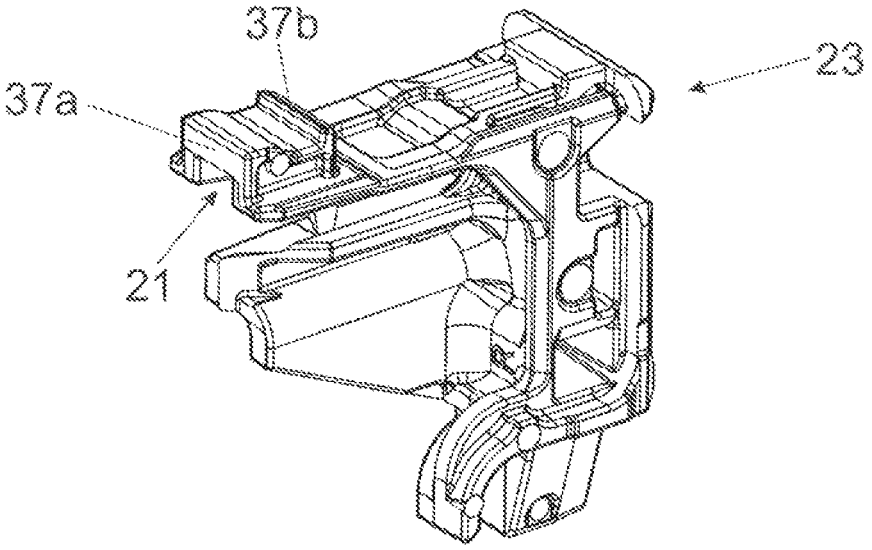
FIG. 9*a*, 9*b* show a perspective view of the functional head in a slightly modified embodiment and in a mounted condition on the second rail.
Figure 9B:
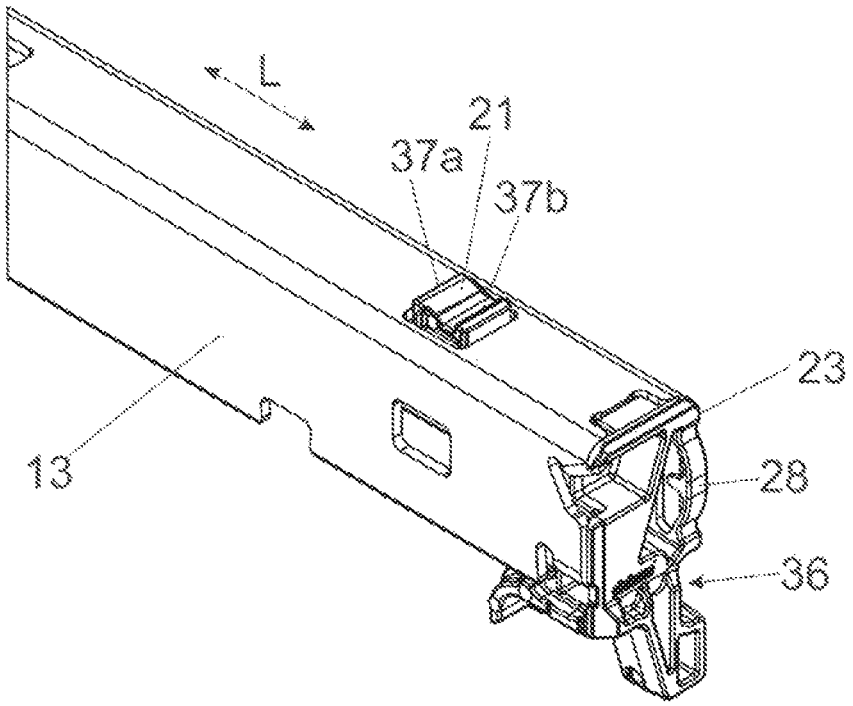

FIG. 9*a* shows the functional head 23 in a slightly modified embodiment. The locking element 21 includes a first abutment surface 37*a* and at least one second abutment surface 37*b*, and the first abutment surface 37*a* or, alternatively, the second abutment surface 37*b* can be engaged with the first rail 12, so that the second rail 13, starting from the fully closed position, can be moved into an open position by the co-operation of the first abutment surface 37*a* with the first rail 12 or, alternatively, by the co-operation of the second abutment surface 37*b* with the first rail 12. The second abutment surface 37*b* is thus provided to entrain the second rail 13 of the drawer pull-out guide 4 with the first rail 12, upon a defective locking, from the fully closed position into an open position. A defective locking may be brought about, for example, when the insertion movement of the drawer 3 is very slowly performed, whereby the first rail 12 would not duly be connected to the first abutment surface 37*a*. FIG. 9*b* shows the functional head 23 shown in FIG. 9*a* in a mounted condition on the front-end region of the second rail 13, the two abutment surfaces 37*a*, 37*b* of the locking element 21 protruding from the second rail 13 in an upward direction. The two abutment surfaces 37*a*, 37*b* are spaced from one another in the longitudinal direction (L) of the second rail 13 and extend substantially perpendicular to the longitudinal direction (L) of the second rail 13. If the first rail 12 is duly locked to the locking element 21 of the second rail 13, a portion of the first rail 12 bears against the first abutment surface 37*a* of the locking element 21. On the contrary, if the first rail 12 is defectively locked to the second rail 13, the second rail 13 can be entrained from a fully closed position into an open position by a co-operation of the second abutment surface 37*b* with the first rail 12.

Figure 10A:
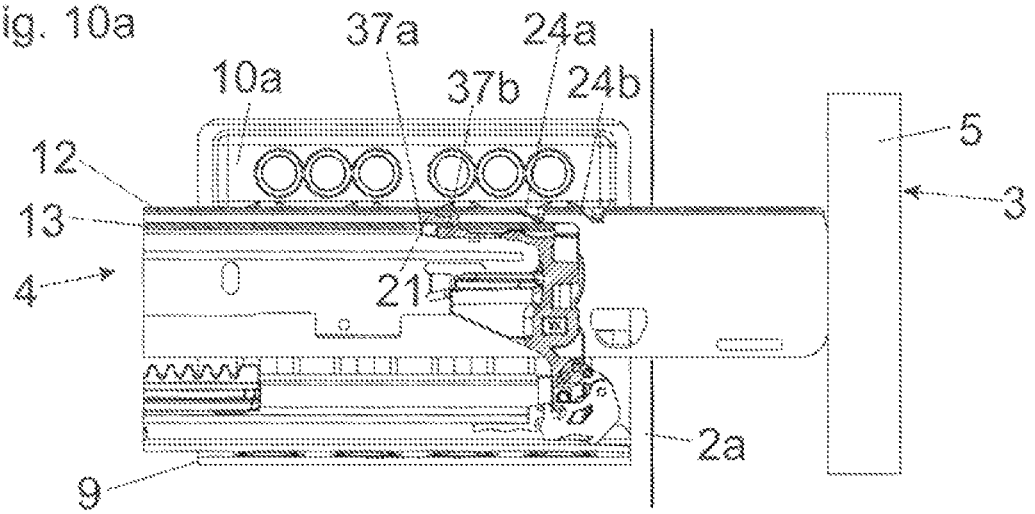
FIG. 10*a*-10*c* show the mounting operation of the drawer on the drawer pull-out guide with a defective locking between the rails.
Figure 10B:
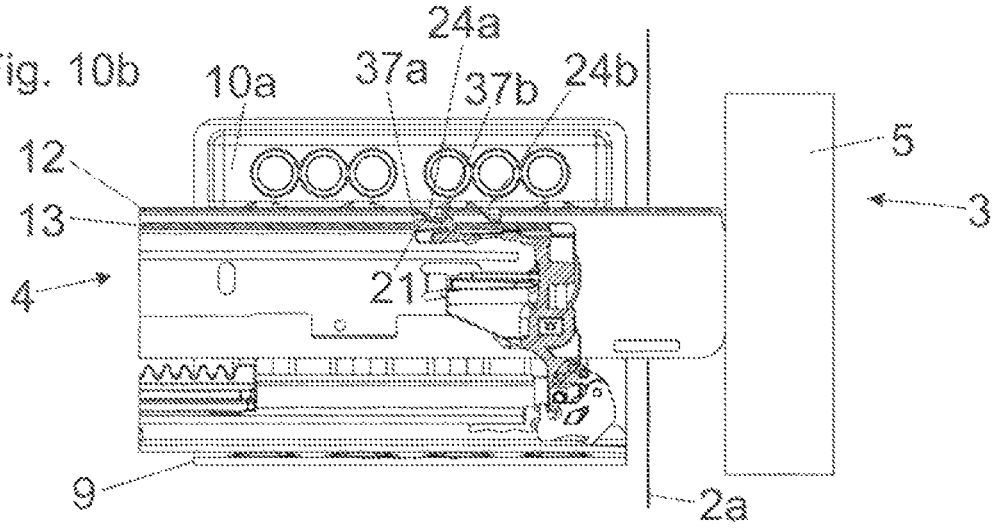
Figure 10C:
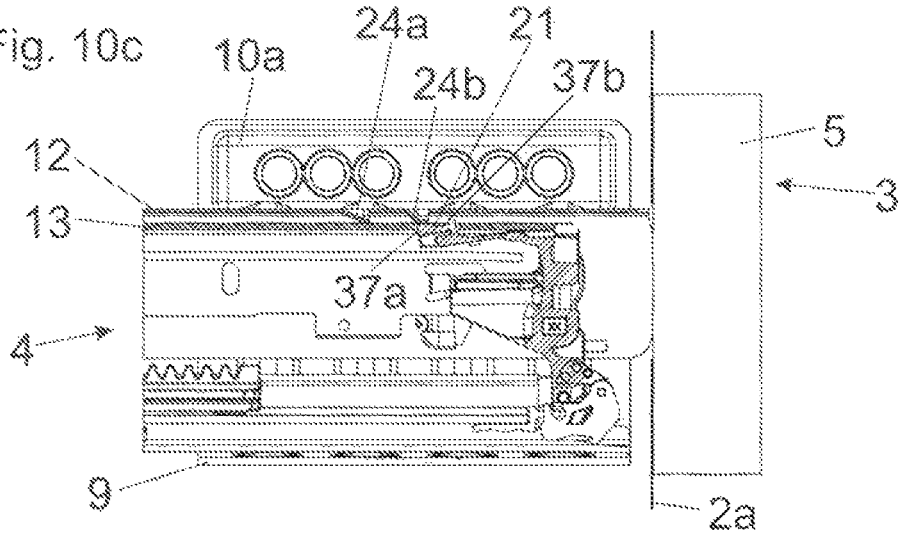

When now the first rail 12, upon mounting the drawer 3, is slid, starting from FIG. 10*a*, onto the second rail 13 of the drawer pull-out guide 4, the locking element 21 of the second rail 13 is bent downwardly against its resilient action, due to the co-operation with the first protrusion 24*a* (FIG. 10*b*). Upon a further movement of the first rail 12 of the drawer 3 in the closing direction, the front panel 5 of the drawer 3 abuts against the front face 2*a* of the furniture carcass 2, and, as a result, cannot further be moved in the closing direction (FIG. 10*c*). In FIG. 10*c*, it is also visible that the locking element 21 of the second rail 13 is not duly locked to the second protrusion 24*b* of the first rail 12, because the second protrusion 24*b* directly bears against the locking element 21. A defective locking between the rails 12, 13 cannot be corrected by a continued movement of the drawer 3 in the closing direction, because the front panel 5 bears against the front face 2*a* of the furniture carcass 2, and, as a result, a further movement of the drawer 3 in the closing direction is not possible. A defective locking between the rails 12, 13 would also lead to the fact that the drawer 3 undesirably remains in an open position.

Figure 11A:
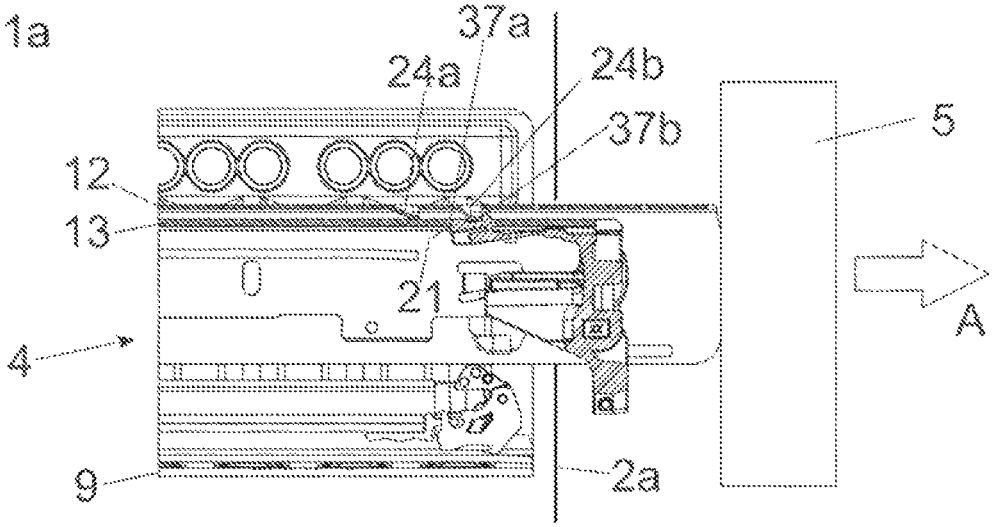
FIG. 11*a*-11*c* show the establishing of a correct connection between the rails.

For establishing a correct locking between the rails 12, 13, the drawer 3 (and therewith the first rail 12) is initially pulled in the extension direction (A), see FIG. 11*a*. The first rail 12, for example the second protrusion 24*b* of the first rail 12, can be coupled to the second abutment surface 37*b* of the locking element 21. Due to the co-operation of the first rail 12 with the second abutment surface 37*b* of the locking element 21, the second rail 12 can be pulled from a fully closed position into an open position.

Figure 11B:
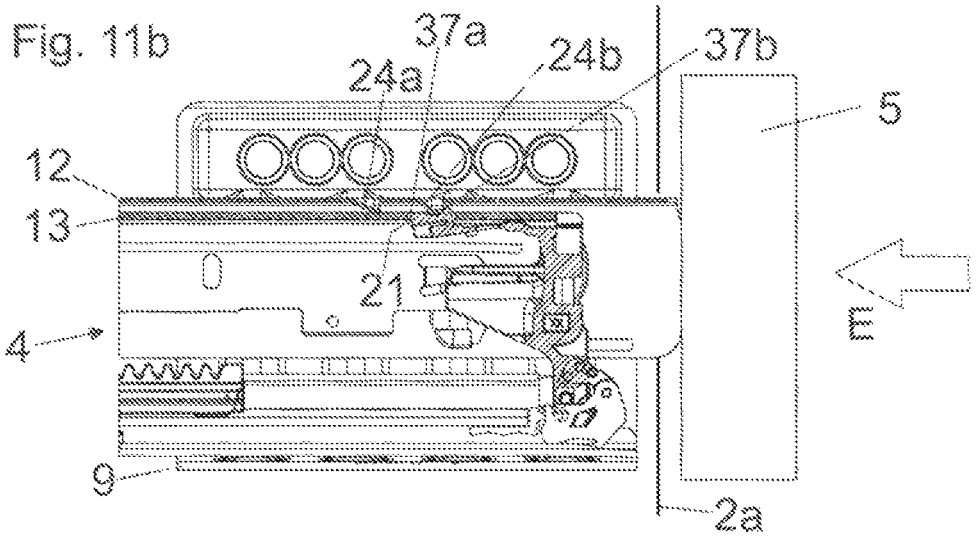
Figure 11C:
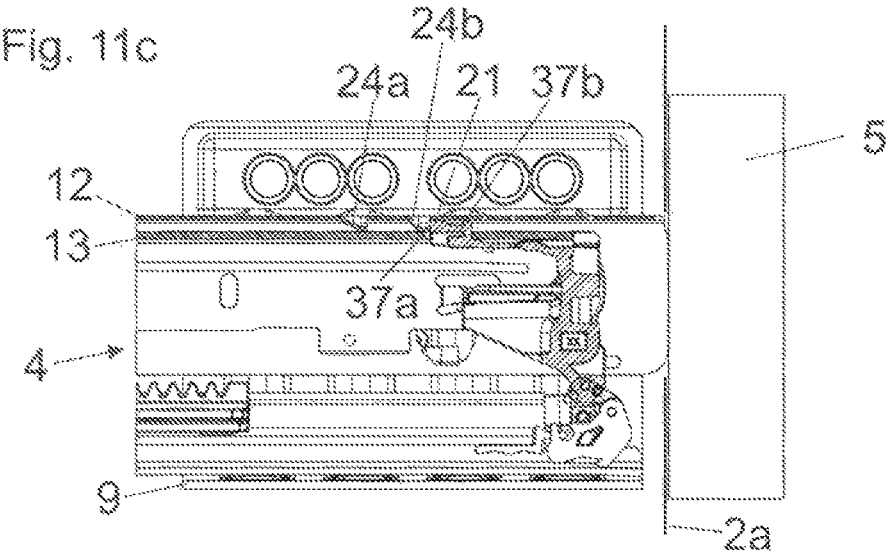

In FIG. 11*b*, the drawer 3 has again been moved in the insertion direction (E), and the relative position between the second protrusion 24*b* and the second abutment surface 37*b* has remained unchanged due to the occurring friction between the rails 12, 13. Upon a continued movement of the drawer 3 in the insertion direction (E), the first rail 12 (and therewith the second protrusion 24*b*) is further moved in the insertion direction (E), whereby the locking element 21 snaps back and the first abutment surface 37*a* bears against the first rail 12, preferably against the second protrusion 24*b* of the first rail 12, without clearance. The correct locking between the rails 12, 13 is shown in FIG. 11*c*, in which the rails 12, 13, in the locked condition, are arranged so as to be stationary relative to one another.

The invention claimed is:

1. A drawer rail for a drawer pull-out guide, the drawer rail comprising:

a first rail configured to be fixed to a drawer, a second rail configured to be arranged on a carcass rail or on a central rail of a drawer pull-out guide, the first rail and the second rail being configured to be connected to one another by sliding onto each other, the first rail and the second rail, in a connected condition, being locked to one another by a locking element, the locking element being pre-stressed by a force of a force storage member in a direction of a locking position, and an unlocking device for unlocking the rails, wherein the unlocking device includes an engagement element arranged on a first one of the first rail and the second rail, the engagement element being received in a recess arranged on a second one of the first rail and the second rail, the engagement element being received in the recess with a play in a height direction in the connected condition of the rails, wherein the locking element is arranged on the second rail and is configured to be pivoted, upon sliding the first rail onto the second rail, about a horizontally extending axis in a mounted position, starting from the locking position, against a force of the force storage member in a direction of a carcass rail or a central rail of the drawer pull-out guide into an unlocking position, and wherein the recess includes a control curve, and the engagement element is configured to, starting from a connected condition of the rails, be guided along the control curve by manually lifting the first rail in the height direction relative to the second rail.

2. The drawer rail according to claim 1, wherein the locking element is movably supported on a front-end region of the second rail.

3. The drawer rail according to claim 1, wherein the locking element is configured to be passed through an opening of the second rail.

4. The drawer rail according to claim 1, wherein the locking element, together with the force storage member, has an integral one-piece construction.

5. The drawer rail according to claim 1, wherein a protrusion is arranged on the first rail, and the locking element is configured to be releasably locked to the protrusion.

6. The drawer rail according to claim 5, wherein the protrusion includes an inclined surface portion for moving the locking element in a direction of the unlocking position upon sliding the rails onto one another.

7. The drawer rail according to claim 1, wherein a first protrusion and a second protrusion are provided on the first rail, the first protrusion and the second protrusion being spaced from one another in a longitudinal direction of the first rail, wherein the locking element is configured to be releasably locked with the first protrusion in a pre-locking position of the first rail and the second rail, and is configured to be releasably locked with the second protrusion in the connected condition of the first rail and the second rail.

8. The drawer rail according to claim 1, wherein the locking element includes a first abutment surface and a second abutment surface, wherein the first abutment surface or, alternatively, the second abutment surface is configured to be engaged with the first rail, so that the second rail, starting from the fully closed position, can be moved into an open position by the co-operation of the first abutment surface with the first rail or, alternatively, by the co-operation of the second abutment surface with the first rail.

9. The drawer rail according to claim 1, wherein at least one of the rails includes two side limbs and a middle limb connecting the side limbs, wherein the locking element, in the connected condition of the rails, is covered by the middle limb of the at least one of the rails.

10. The drawer rail according to claim 1, wherein the control curve includes a portion extending in an extension direction of the drawer, wherein the engagement element is further configured to, after having lifted the first rail in the height direction, be limitedly moved along the portion extending in the extension direction with a component in the extension direction.

11. The drawer rail according to claim 10, wherein the control curve includes a vertical portion adjoining the first portion, wherein the engagement element is further configured to, after having been moved along the first portion, be guided along the vertical portion by manually lowering the first rail relative to the second rail in the height direction, and wherein the first rail is configured to be released from the second rail after the engagement element has been moved along the vertical portion.

12. A drawer pull-out guide comprising:

a carcass rail to be fixed to a furniture carcass; and the drawer rail according to claim 1, wherein the drawer rail is displaceably supported relative to the carcass rail.

13. An item of furniture comprising:

a furniture carcass, a drawer displaceably supported relative to the furniture carcass, and the drawer rail according to claim 1, wherein the first rail is mounted to the drawer and the second rail is mounted to the furniture carcass, wherein the first rail connected to the drawer is configured to be connected to the second rail by sliding the first rail onto the second rail.

14. A method of connecting the first rail to the second rail of the drawer rail according to claim 1, said method comprising:

placing the first rail configured to be fixed to the drawer onto the second rail configured to be arranged on the carcass rail or on the central rail of a drawer pull-out guide, sliding the first rail onto the second rail, pivoting the locking element of the second rail about the horizontally extending axis in the mounted position, against the force of the force storage member, in a direction of the carcass rail or the central rail of the drawer pull-out guide into the unlocking position, and moving the locking element into the locking position by the force of the force storage member, whereby the first rail and the second rail are locked to one another.

15. The method according to claim 14, wherein, for releasing the locking between the first rail and the second rail, the first rail is configured to be lifted relative to the second rail, subsequently moved in an extension direction, subsequently lowered relative to the second rail, and subsequently further to be moved in the extension direction.

16. The drawer rail according to claim 1, wherein the locking element and the force storage member are configured as components separate from one another.

* * * * *